US012421074B2

(12) United States Patent
Liu

(10) Patent No.: US 12,421,074 B2
(45) Date of Patent: Sep. 23, 2025

(54) HOSE TELESCOPIC DEVICE WITH LOCKING STRUCTURE

(71) Applicant: Kaiping Linlong Sanitary Ware Technology Co., Ltd., Kaiping (CN)

(72) Inventor: Jijun Liu, Changning (CN)

(73) Assignee: Kaiping Linlong Sanitary Ware Technology Co., Ltd., Kaiping (CN)

( * ) Notice: Subject to any disclaimer, the term of this patent is extended or adjusted under 35 U.S.C. 154(b) by 305 days.

(21) Appl. No.: 18/452,867

(22) Filed: Aug. 21, 2023

(65) Prior Publication Data

US 2025/0033926 A1 Jan. 30, 2025

(30) Foreign Application Priority Data

Jul. 28, 2023 (CN) ..... 202310940951.6

(51) Int. Cl.
*F16L 37/35* (2006.01)
*B65H 75/44* (2006.01)

(52) U.S. Cl.
CPC ..... *B65H 75/4423* (2013.01); *B65H 75/4471* (2013.01); *B65H 2701/33* (2013.01)

(58) Field of Classification Search
CPC ..... F16L 37/35; F16L 37/36; B65H 75/4423; B65H 75/4431; B65H 75/4471
See application file for complete search history.

(56) References Cited

U.S. PATENT DOCUMENTS

| | | | | |
|---|---|---|---|---|
| 11,014,777 | B2 * | 5/2021 | Tang | B65H 75/4431 |
| 11,739,872 | B2 * | 8/2023 | Casura | A61M 39/1011 251/149.1 |
| 12,140,256 | B2 * | 11/2024 | Casura | A61M 39/165 |
| 12,140,257 | B2 * | 11/2024 | Stangl | F16L 37/36 |

FOREIGN PATENT DOCUMENTS

| | | | |
|---|---|---|---|
| CN | 218221424 | U | 1/2023 |
| CN | 218294612 | U | 1/2023 |
| CN | 218326432 | U | 1/2023 |

* cited by examiner

*Primary Examiner* — Sang K Kim
(74) *Attorney, Agent, or Firm* — Nitin Kaushik

(57) ABSTRACT

The present disclosure discloses a hose telescopic device with a locking structure, including: a hose, a receiving assembly and a locking structure, wherein one end of the hose is received in the receiving assembly, and the other end of the hose passes through the receiving assembly and the locking structure successively, and the locking structure includes a locking seat, the locking seat being provided with several locking pawls having elasticity, the locking pawls being used for locking the hose, and the locking seat being sheathed with a locking piece used for tightening or loosening the locking pawls. The locking seat is sheathed with a locking piece for tightening or loosening the locking pawls, and the locking pawls lock the hose, to provide a hose telescopic device with a locking structure, which is convenient for locking the hose after drawing, and expands the scope of application for drawing hose.

10 Claims, 9 Drawing Sheets

HOSE TELESCOPIC DEVICE WITH LOCKING STRUCTURE

CROSS-REFERENCE TO RELATED APPLICATIONS

The application claims priority to Chinese patent application No. 2023109409516, filed on Jul. 28, 2023, the entire contents of which are incorporated herein by reference.

TECHNICAL FIELD

The present disclosure relates to the technical field of hose locking, and more particularly to a hose telescopic device with a locking structure.

BACKGROUND

In the prior art, a hose is widely used in industry and everyday life, and a drawing hose is wound and received by means of a receiving assembly. However, the conventional receiving assembly has only a drawing and recycling function, and cannot lock the drawing hose, resulting in a narrow scope of application for drawing hose.

Therefore, how to provide a hose telescopic device with a locking structure to lock the hose after drawing and expand the scope of application for drawing hose becomes an urgent technical problem to be solved.

SUMMARY

The technical problem to be solved by the present disclosure is how to provide a hose telescopic device with a locking structure to lock the hose after drawing and expand the scope of application for drawing hose.

To this end, according to a first aspect, the present disclosure discloses a hose telescopic device with a locking structure, including: a hose, a receiving assembly and a locking structure, wherein one end of the hose is received in the receiving assembly, and the other end of the hose passes through the receiving assembly and the locking structure successively, and the locking structure includes a locking seat, the locking seat being provided with several locking pawls having elasticity, the locking pawls being used for locking the hose, and the locking seat being sheathed with a locking piece used for tightening or loosening the locking pawls.

The present disclosure further provides that the locking piece includes a locking ring, the locking ring being provided therein with locking latches adapted to the locking pawls.

The present disclosure further provides that the locking pawls are provided with a first ramp and the locking latches are provided with a second ramp adapted to the first ramp.

The present disclosure further provides that the locking ring is provided with a shift lever for conveniently shifting the locking ring for rotation.

The present disclosure further provides that the shift lever is integrally formed with the locking ring.

The present disclosure further provides that the locking structure further includes a ferrule sleeved on the locking seat, the ferrule being used for clamping and limiting the locking seat.

The present disclosure further provides that the locking seat is screwed with a fastening seat for fastening the locking structure.

The present disclosure further provides that the locking seat is sheathed with a wear ring abutting against the locking piece.

The present disclosure further provides that the receiving assembly includes a receiving plate, a first box board and a second box board, the first box board being detachably connected to the second box board, the receiving plate being rotatably connected to the first box board and the second box board, respectively, the hose being wound around the receiving plate, and a winding spring being mounted on one side of the receiving plate.

The present disclosure further provides that a plastic card is rotatably connected to the first box board, one end of the plastic card is hooked with a first spring, the first spring is fastened to the first box board by a fastening screw, the receiving plate is provided with a latch portion and a smooth portion, and the plastic card is clamped with the latch portion.

The present disclosure has the following advantageous effects: the locking seat is sheathed with a locking piece for tightening or loosening the locking pawls, and the locking pawls lock the hose, to provide a hose telescopic device with a locking structure, which is convenient for locking the hose after drawing, and expands the scope of application for drawing hose.

BRIEF DESCRIPTION OF DRAWINGS

In order to more clearly state the detailed description of the present disclosure or the technical scheme in the prior art, the following is a brief introduction of the drawings required to be used in the description of the detailed description of the present disclosure or the prior art. It is obvious that the drawings in the description below are some embodiments of the present disclosure, and other drawings may be obtained by a person skilled in the art without involving any inventive effort.

Figure 1:
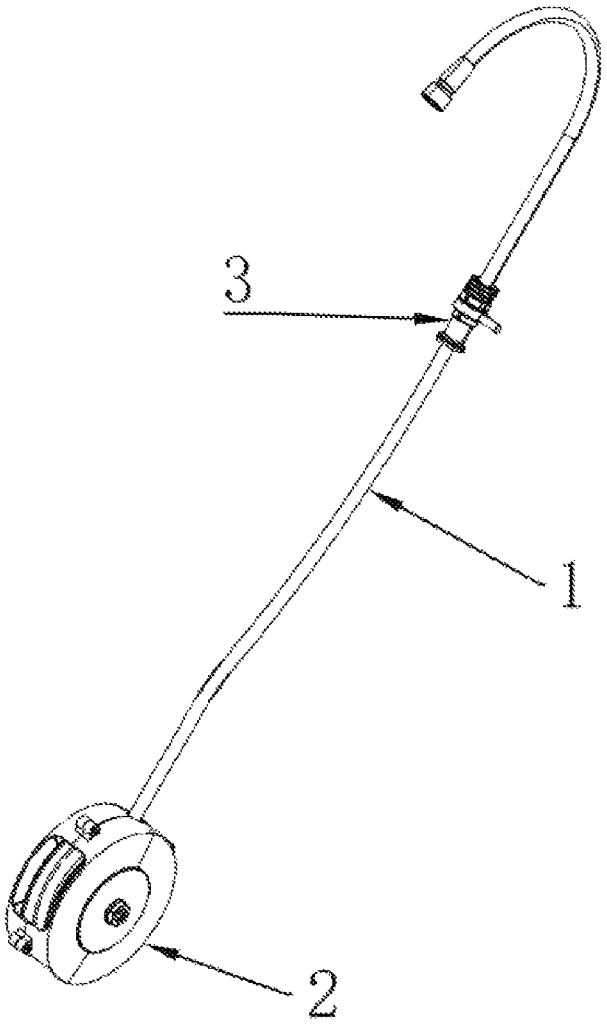
FIG. 1 is a schematic perspective view of a hose telescopic device with a locking structure disclosed in the embodiment.

Reference numerals: 1. hose: 2. receiving assembly: 21. receiving plate: 211. latch portion: 212. smooth portion: 22. first box board: 23. second box board: 24. winding spring:

25. plastic card: 26. first spring: 27. fastening screw: 28. isolating plate: 29. decorative plate: 3. locking structure: 31. locking seat: 311. locking pawl: 3111. first ramp: 32. locking piece: 321. locking ring: 322. locking latch: 3221. second ramp: 323. shift lever: 33. ferrule: 34. fastening seat: 35. wear ring.

DETAILED DESCRIPTION OF THE EMBODIMENTS

In order to make the objects, technical schemes and advantages of the present disclosure more clearly understood, the present disclosure will now be described in further detail with reference to the accompanying drawings and embodiments. It should be understood that the particular embodiments described herein are merely illustrative of the present disclosure and are not intended to be limiting.

In the description of the present disclosure, it should be noted that, unless expressly specified or limited otherwise, the terms "mounted", "connecting", and "connected" are to be interpreted broadly, e.g. either fixedly or detachably, or integrally connected: may be mechanically or electrically connected: may be directly or indirectly connected through an intermediate medium, and may also be connected within two elements, and may be connected wirelessly or wiredly. The specific meaning of the above terms in the present disclosure may be understood in detail by those skilled in the art.

In the description of the present disclosure, it should be noted that the terms "central", "upper", "lower", "left", "right", "vertical", "horizontal", "inner", "outer", and the like designate orientations or positional relationships based on the orientation or positional relationships shown in the drawings, are merely for convenience in describing the present disclosure and to simplify the description, and do not indicate or imply that the referenced devices or elements must have a particular orientation, be constructed and operated in a particular orientation, and thus should not be construed as limiting the present disclosure. Furthermore, the terms "first", "second", and "third" are used for descriptive purposes only and are not to be construed as indicating or implying relative importance.

Furthermore, the technical features involved in the different embodiments of the present disclosure described below may be combined with each other as long as they do not conflict with each other.

The embodiment of the present disclosure discloses a hose telescopic device with a locking structure, as shown in FIGS. 1-8, including: a hose 1, a receiving assembly 2 and a locking structure 3, wherein one end of the hose 1 is received in the receiving assembly 2, and the other end of the hose 1 passes through the receiving assembly 2 and the locking structure 3 successively, and the locking structure 3 includes a locking seat 31, the locking seat 31 being provided with several locking pawls 311 having elasticity, the locking pawls 311 being used for locking the hose 1, and the locking seat 31 being sheathed with a locking piece 32 used for tightening or loosening the locking pawls 311.

It should be noted that the locking seat 31 is sheathed with a locking piece 32 for tightening or loosening the locking pawls 311, and the locking pawls 311 lock the hose 1, to provide a hose telescopic device with a locking structure, which is convenient for locking the hose 1 after drawing, and expands the scope of application for drawing hose 1.

As shown in FIGS. 2, 3, 4 and 8, the locking piece 32 includes a locking ring 321, the locking ring 321 being provided therein with locking latches 322 adapted to the locking pawls 311. In a specific implementation, the number of the locking pawls 311 is set to be plural, a plurality of the locking pawls 311 are equally spaced along the circumferential direction of the locking seat 31, the number of the locking latches 322 is set to be plural, and a plurality of the locking latches 322 are equally spaced along the circumferential direction of the locking ring 321. It should be noted that the locking pawls 311 are pressed by the locking latches 322, and the locking pawls 311 are retracted inward to clamp the hose 1.

As shown in FIGS. 2, 3, 4 and 8, the locking pawls 311 are provided with a first ramp 3111 and the locking latches 322 are provided with a second ramp 3221 adapted to the first ramp 3111. It should be noted that the provision of the first ramp 3111 and the second ramp 3221 facilitates the pressing of the locking pawls 311 when the locking piece 32 rotates, so that the locking pawls 311 are retracted inward to clamp the hose 1.

As shown in FIGS. 2, 3, 4 and 8, the locking ring 321 is provided with a shift lever 323 for conveniently shifting the locking ring 321 for rotation. It should be noted that the provision of the shift lever 323 facilitates the rotation of the locking piece 32 by the user, saving manpower and facilitating the operation.

Figure 8:
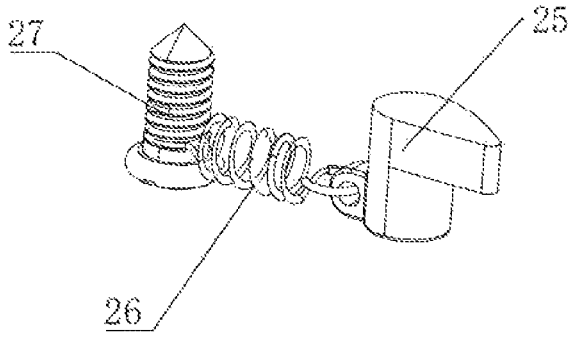
FIG. 8 is a schematic structure view of a locking piece in a hose telescopic device with a locking structure disclosed in the embodiment.
Figure 9:
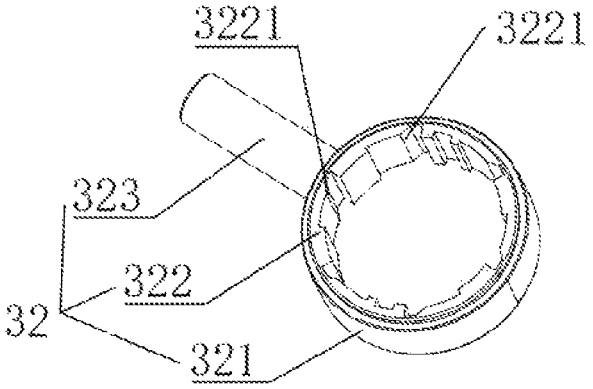
FIG. 9 is a schematic partial structure view of a hose telescopic device with a locking structure disclosed in the embodiment.

As shown in FIG. 8, the shift lever 323 is integrally formed with the locking ring 321. It should be noted that since the shift lever 323 is integrally formed with the locking ring 321, the structure of the locking piece 32 is more stable.

Figure 2:
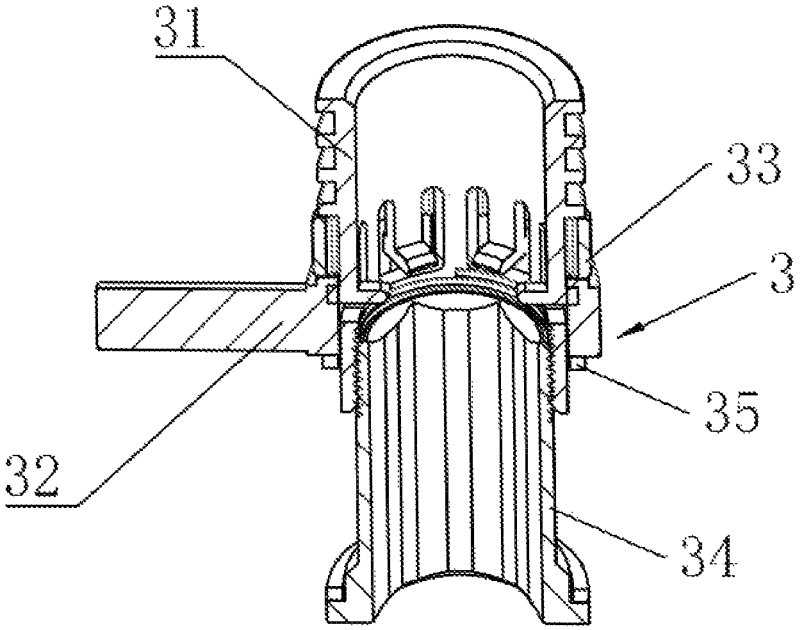
FIG. 2 is a schematic half-sectional structure view of a locking structure in a hose telescopic device with a locking structure disclosed in the embodiment.
Figure 3:
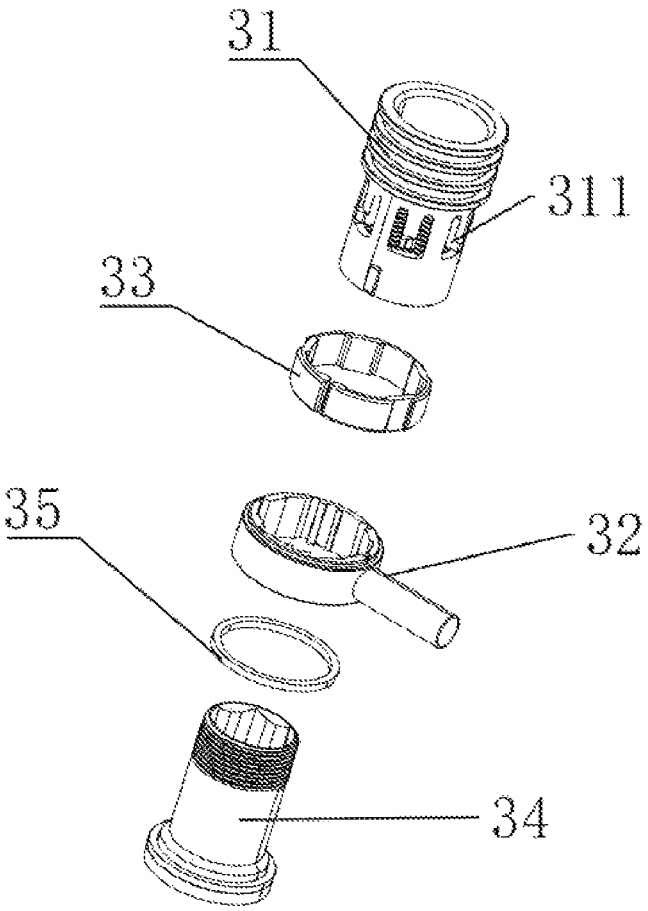
FIG. 3 is a schematic explosive structure view of a locking structure in a hose telescopic device with a locking structure disclosed in the embodiment.
Figure 4:
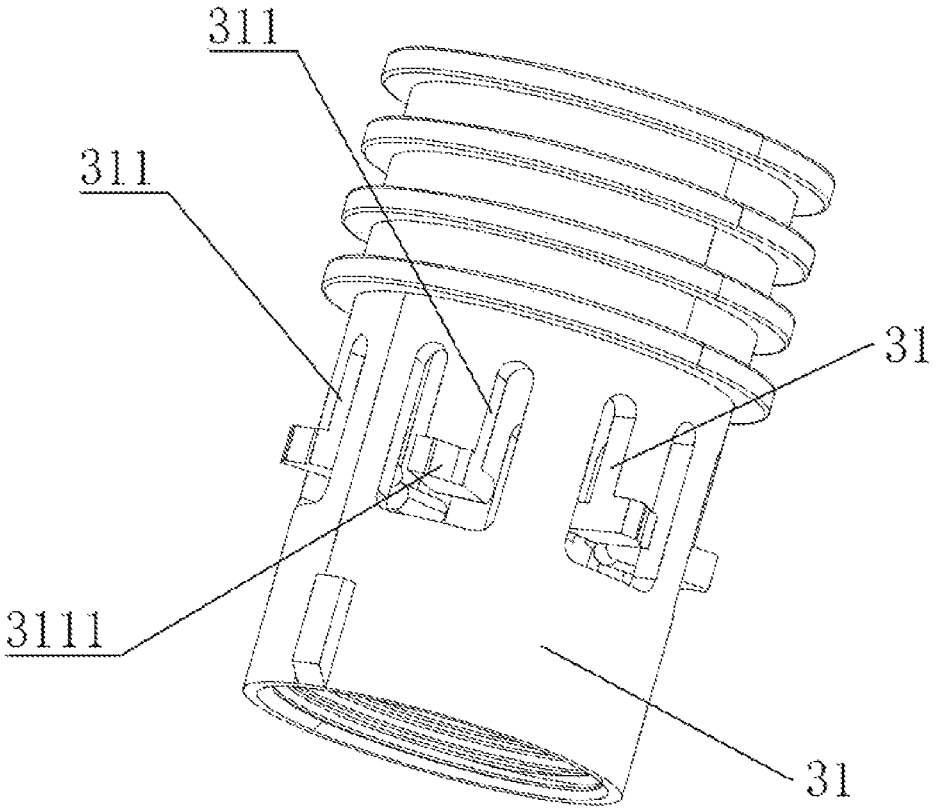
FIG. 4 is a schematic structure view of a locking seat in a hose telescopic device with a locking structure disclosed in the embodiment.

As shown in FIGS. 2-4, the locking structure 3 further includes a ferrule 33 sleeved on the locking seat 31, the ferrule 33 being used for clamping and limiting the locking seat 31. It should be noted that the ferrule 33 serves as a stopper for preventing the locking piece 32 from being separated from the locking seat 31.

As shown in FIGS. 2-4, the locking seat 31 is screwed with a fastening seat 34 for fastening the locking structure 3. It should be noted that the fastening seat 34 serves a mounting function for fixing the locking structure 3 in a certain position.

As shown in FIGS. 2-4, the locking seat 31 is sheathed with a wear ring 35 abutting against the locking piece 32. It should be noted that the wear ring 35 serves a wear resistance function for facilitating the rotation of the locking piece 32 and preventing the locking piece 32 from wearing the locking seat 31.

As shown in FIGS. 1, 5, 6 and 7, the receiving assembly 2 includes a receiving plate 21, a first box board 22 and a second box board 23, the first box board 22 being detachably connected to the second box board 23, the receiving plate 21 being rotatably connected to the first box board 22 and the second box board 23, respectively, the hose 1 being wound around the receiving plate 21, and a winding spring 24 being mounted on one side of the receiving plate 21. In a specific implementation, one side of the second box board 23 is fixedly mounted with an isolating plate 28 for isolating the winding spring 24.

Figure 5:
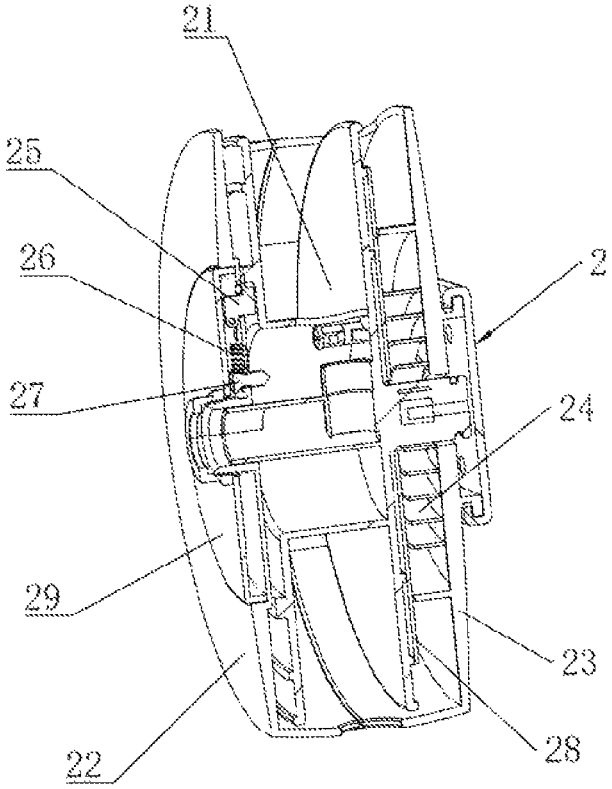
FIG. 5 is a schematic half-sectional structure view of a receiving assembly in a hose telescopic device with a locking structure disclosed in the embodiment.
Figure 6:
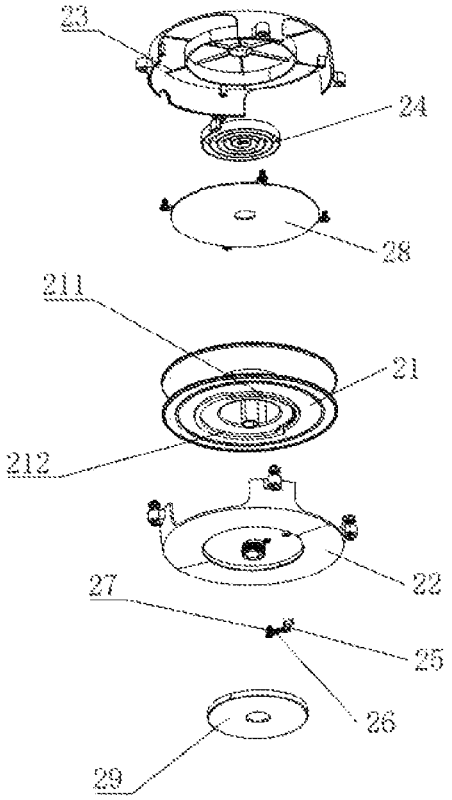
FIG. 6 is a first schematic explosive structure view of a receiving assembly of a hose telescopic device with a locking structure disclosed in the embodiment.
Figure 7:
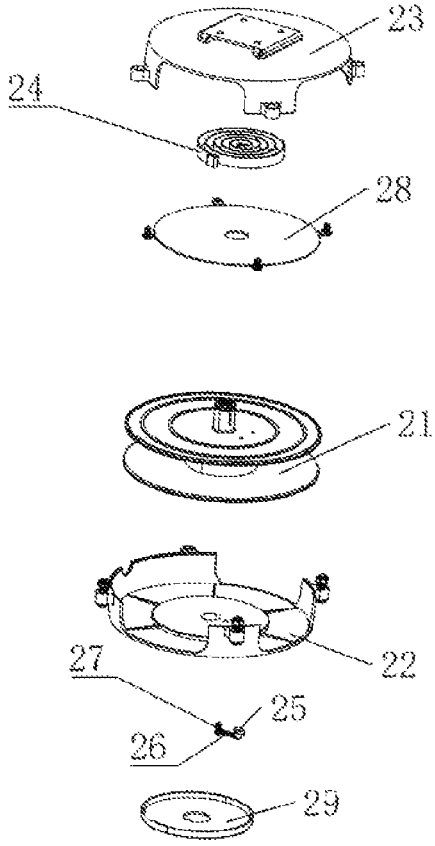
FIG. 7 is a second schematic explosive structure view of a receiving assembly of a hose telescopic device with a locking structure disclosed in the embodiment.

As shown in FIGS. 5-7, a plastic card 25 is rotatably connected to the first box board 22, one end of the plastic card 25 is hooked with a first spring 26, the first spring 26 is fastened to the first box board 22 by a fastening screw 27, the receiving plate 21 is provided with a latch portion 211 and a smooth portion 212, and the plastic card 25 is clamped with the latch portion 211. In a specific implementation, a decorative plate 29 for covering the plastic card 25, the first spring 26 and the fastening screw 27 is mounted on one side of the first box board 22.

It should be noted that when one end of the plastic card 25 is clamped with the latch portion 211, the winding spring 24 is prevented from driving the receiving plate 21 to rotate; when one end of the plastic card 25 is located at the smooth portion 212, the winding spring 24 facilitates to drive the receiving plate 21 to rotate, so that the hose 1 may be retracted.

Working principle: the locking seat 31 is sheathed with a locking piece 32 for tightening or loosening the locking pawls 311, and the locking pawls 311 lock the hose 1, to provide a hose telescopic device with a locking structure, which is convenient for locking the hose 1 after drawing, and expands the scope of application for drawing hose 1.

It is to be understood that the above-described embodiments are merely illustrative for clarity and are not restrictive of the embodiments. For a person of ordinary skill in the art, other variations and modifications are possible in the light of the above description. All embodiments need not be, and cannot be, exhaustive herein. Obvious variations and modifications derived therefrom still remain within the scope of the present disclosure.

What is claimed is:

1. A hose telescopic device with a locking structure, comprising: a hose (1), a receiving assembly (2) and a locking structure (3), wherein one end of the hose (1) is received in the receiving assembly (2), and the other end of the hose (1) passes through the receiving assembly (2) and the locking structure (3) successively, and the locking structure (3) comprises a locking seat (31), the locking seat (31) being provided with several locking pawls (311) having elasticity, the locking pawls (311) being used for locking the hose (1), and the locking seat (31) being sheathed with a locking piece (32) used for tightening or loosening the locking pawls (311).

2. The hose telescopic device with a locking structure according to claim 1, wherein the locking piece (32) comprises a locking ring (321), the locking ring (321) being provided therein with locking latches (322) adapted to the locking pawls (311).

3. The hose telescopic device with a locking structure according to claim 2, wherein the locking pawls (311) are provided with a first ramp (3111) and the locking latches (322) are provided with a second ramp (3221) adapted to the first ramp (3111).

4. The hose telescopic device with a locking structure according to claim 2, wherein the locking ring (321) is provided with a shift lever (323) for conveniently shifting the locking ring (321) for rotation.

5. The hose telescopic device with a locking structure according to claim 4, wherein the shift lever (323) is integrally formed with the locking ring (321).

6. The hose telescopic device with a locking structure according to claim 1, wherein the locking structure (3) further comprises a ferrule (33) sleeved on the locking seat (31), the ferrule (33) being used for clamping and limiting the locking seat (31).

7. The hose telescopic device with a locking structure according to claim 1, wherein the locking seat (31) is screwed with a fastening seat (34) for fastening the locking structure (3).

8. The hose telescopic device with a locking structure according to claim 1, wherein the locking seat (31) is sheathed with a wear ring (35) abutting against the locking piece (32).

9. The hose telescopic device with a locking structure according to claim 1, wherein the receiving assembly (2) comprises a receiving plate (21), a first box board (22) and a second box board (23), the first box board (22) being detachably connected to the second box board (23), the receiving plate (21) being rotatably connected to the first box board (22) and the second box board (23), respectively, the hose (1) being wound around the receiving plate (21), and a winding spring (24) being mounted on one side of the receiving plate (21).

10. The hose telescopic device with a locking structure according to claim 9, wherein a plastic card (25) is rotatably connected to the first box board (22), one end of the plastic card (25) is hooked with a first spring (26), the first spring (26) is fastened to the first box board (22) by a fastening screw (27), the receiving plate (21) is provided with a latch portion (211) and a smooth portion (212), and the plastic card (25) is clamped with the latch portion (211).

* * * * *